United States Patent [19]

Gluck et al.

[11] 4,064,833

[45] Dec. 27, 1977

[54] TONER DENSITY CONTROLLER

[75] Inventors: Julius Gluck, Noroton Heights, Conn.; Bheema Rao Vijayendran, Berkley Heights, N.J.

[73] Assignee: Pitney-Bowes, Inc., Stamford, Conn.

[21] Appl. No.: 739,605

[22] Filed: Nov. 8, 1976

[51] Int. Cl.[2] ..... B05B 5/00; G03G 13/00

[52] U.S. Cl. ..... 118/646; 350/61

[58] Field of Search ..... 118/646, 9; 350/61

[56] References Cited

U.S. PATENT DOCUMENTS

| | | | |
|---|---|---|---|
| 3,316,468 | 4/1967 | Hanks | 118/9 X |
| 3,399,652 | 9/1968 | Gawron | 118/646 |
| 3,430,606 | 3/1969 | Please et al. | 118/646 |
| 3,682,132 | 8/1972 | Kamola | 118/646 X |
| 3,872,824 | 3/1975 | Erny et al. | 118/646 X |

FOREIGN PATENT DOCUMENTS

| | | | |
|---|---|---|---|
| 4,520,084 | 3/1962 | Japan | 118/9 |

*Primary Examiner*—Mervin Stein
*Assistant Examiner*—Andrew Falik
*Attorney, Agent, or Firm*—Peter Vrahotes; William D. Soltow, Jr.; Albert W. Scribner

[57] ABSTRACT

A toner density controller for determining the density of a development material in a magnetic brush assembly of an electrostatic copier is disclosed. Means is provided for imposing a charge on the toner density controller which is opposite in charge to that of the toner particles of the development material. In this way, the toner particles, particularly fines, are repelled from the toner density controller to eliminate interference with the functioning of the controller.

1 Claim, 4 Drawing Figures

TONER DENSITY CONTROLLER

BACKGROUND OF THE INVENTION

Electrostatic copying machines of the type which utilize strip-type photoconductors, including a surface adapted to carry a developable electrostatic latent image, generally utilize dry developer materials that normally include a toner material and a carrier material. For development purposes, the toner material is charged to a polarity opposite to that of the charge of the latent image on the photoconductor. As a consequence, when the developer material is brought into contact with the image bearing surface of the photoconductor, toner material adhers to the image, thereby rendering the same visible. Accordingly, copying machines of the aforesaid type are generally provided with means for contacting the image bearing surface of the photoconductor with developer material from a readily available working supply of the same.

One of the known types of apparatus available for developing latent images is a magnetic-brush developer. For use with such developers, the carrier particles of the developer material are made of a magnetizable material, such as iron. A typical magnetic-brush developer includes a rotating applicator immersed in a working supply of developer material, and a moving magnet which cooperates with the applicator for forming a magnetic field in a space between the applicator and the magnet. Since a photoconductor bearing the electrostatic latent image is also disposed in the field space, with the image surface facing the applicator as the applicator urges developer material into the field space, the field entrains the developer material disposed on the surface of the applicator. As applicator and magnet move in different directions relative to one another, the entrained developer material brushes the image bearing surface of the photoconductor, thereby developing the latent image. The developer material on the applicator is then returned directly to the working supply of developer material, mixed with the same and recycled.

To prevent the working supply of developer material from becoming gradually useless due to wear and tear of the carrier material content and continuous dissipation of the toner material content, the supply must be rejuvenated from time-to-time. This is normally done by adding developer material, including toner and/or carrier material, from a replenishing supply, directly into the working supply of developer material and mixing the added material with the working supply along with the developer material returned to the working supply from the applicator.

In order to determine the amount of developer material which must be added from the replenishing supply, it is necessary to determine the state of the developer material before, during and after the replenishment. This is accomplished through use of a toner density controller which uses the reflective properties of the development material in order to determine its condition. One problem that has been encountered in the use of this type of toner density controller is that the fines in the developer material tend to interfer with the ability to measure reflection as such fines tend to cloud the area between the toner density controller and the developer material.

It has been found that the problem may be alleviated by applying a small voltage to the toner density controller which is opposite in charge to that of the sump containing the toner material. This creates a large differential voltage between the controller and the development material because the sump is polarized with an opposite polarity relative to the controller. In this way, the toner material is repelled away from the toner density controller and the light directed from the latter, as well as the light reflected from the surface of the development material, will not be interferred with by dust or fines usually given off from the toner material.

SUMMARY OF THE INVENTION

This invention is directed to a means for preventing the fines of a toner material from interferring with the ability of a toner density controller to determine the condition of a development material. More specifically, this is directed to the type of toner density controller which utilizes a light source which is reflected from the surface of the development material and measures that reflected light in order to determine the condition of the developer material. A charge having the same polarity as the charge of the toner material is applied to the toner density controller thereby repulsing toner material fines therefrom and preventing toner fines from interferring with the incident light being conveyed from and reflected back to the toner density controller.

BRIEF DESCRIPTION OF THE DRAWINGS

In the ensuing detailed description of the invention, reference may be had to the accompanying drawing wherein like reference numerals designate like or corresponding parts and in which.

DESCRIPTION OF THE PREFERRED EMBODIMENT

Figure 1:
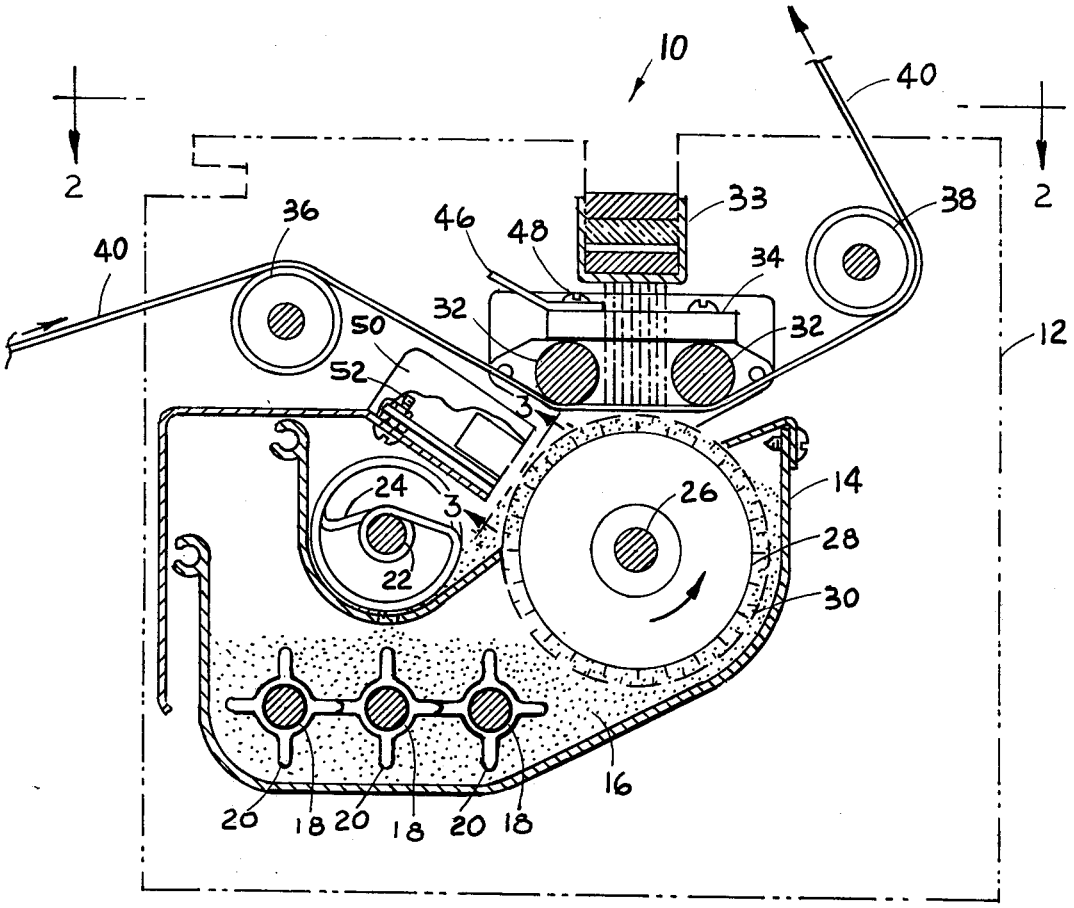
FIG. 1 is a cross-sectional view of a magnetic-brush developer unit of an electrostatic copier with parts removed for clarity.
Figure 2:
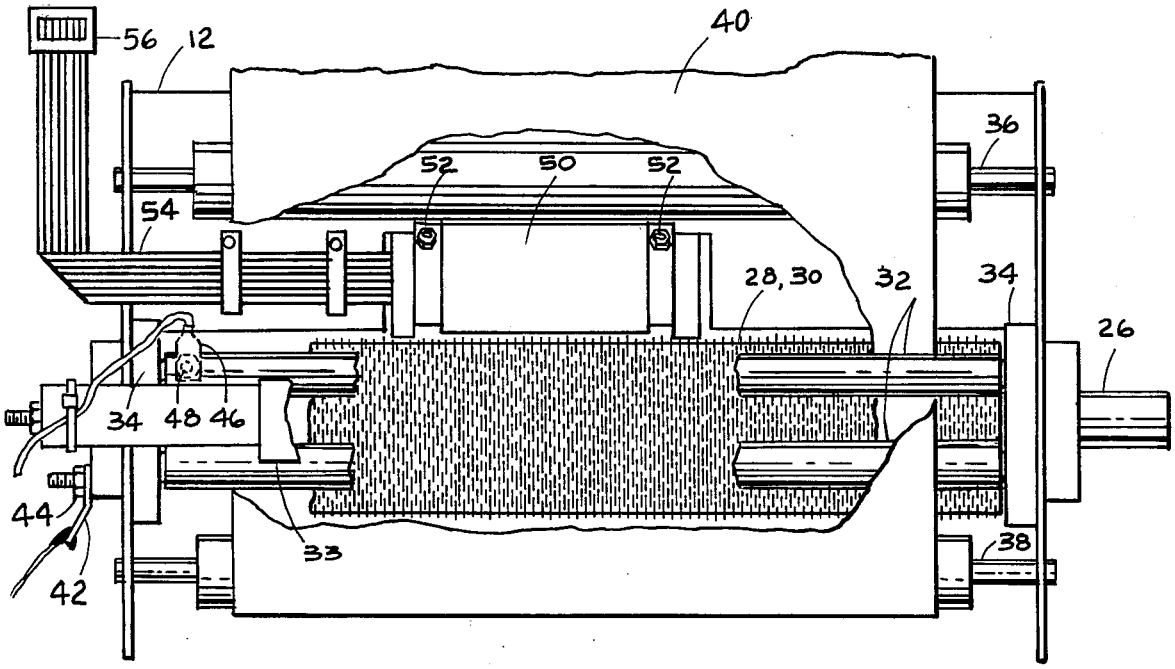
FIG. 2 is a top plan view of the unit shown in FIG. 1 taken along the lines to 2—2.
Figure 3:
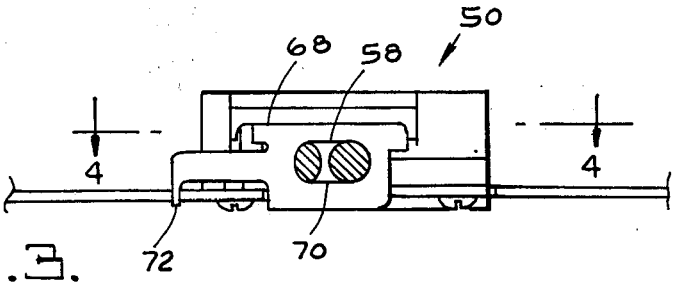
FIG. 3 is a view of a portion of the toner density controller shown in FIG. 2 and taken along the lines 3—3 of FIG. 1.
Figure 4:
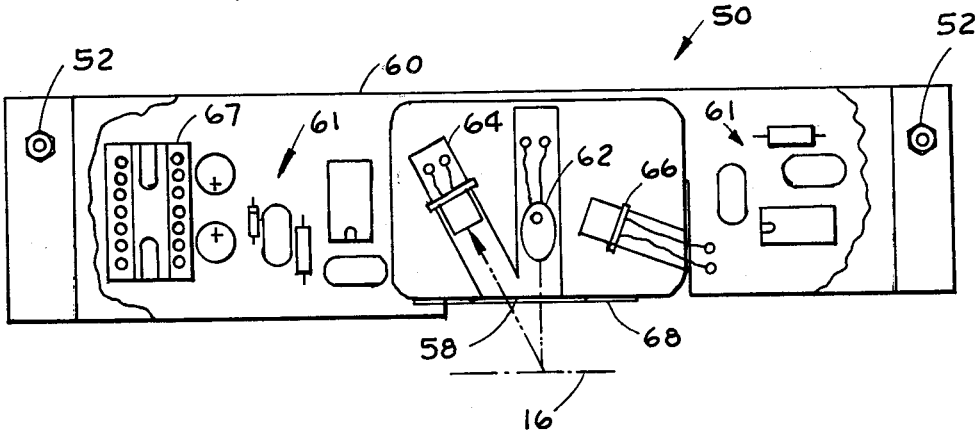
FIG. 4 is a plan view of a portion of the toner density controller shown in FIG. 3 and taken along the lines 4—4.

The preferred embodiment of the invention will be described with reference to the apparatus shown and described in U.S. Pat. No. 3,924,567 and reference may be had to that patent for a fuller description of the apparatus involved. Referring now to the drawing, a magnetic brush assembly of an electrostatic copier is shown generally at 10 and has a housing 12 which supports a sump 14 that contains development material 16 therein. Rotatably disposed within the sump 14 are a plurality of rotatable shafts 18 each having a plurality of spokes 20 extending therefrom. Located above the shafts 18 is another shaft 22 which supports spiral members 24. The function of the spokes 20 and spiral members 24, which are rotated by their shafts 18, 22 respectively, are to mix the components of the developer material 16, which mixing creates a triboelectric charge on the toner particles. For the purposes of this disclosure, it will be assumed that the developer material obtains a positive triboelectric charge. The spokes 20 and spiral 24 are made of non-magnetic materials so that the developer material will not be attracted to the same.

Another shaft 26 is disposed within the sump 14 and has a brush 28 disposed thereabout, which brush has a plurality of magnetizable fibers 30 extending therefrom. Located immediately above the magnetic brush 28 are a pair of laterally extending non-rotatable shafts 32 which are supported by a frame member 34. Disposed above and intermediate the shafts 32 is a a magnetic member 33. A pair of rotatable shafts 36, 38 are disposed on each longitudinal side of the non-rotatable shafts 32 and the combination of the shafts 32, 36, 38 support a photoconductor belt 40 which is conveyed through the housing 12 in the direction indicated by the arrows in FIG. 1.

An electrical connection 42 is secured to the sump 14 as by a bolt 44 to which a charge is provided, as for example, −150 volts, for the purpose of neutralizing the voltage level of the non-image bearing surface of the photoconductor 40. A ground connection 46 is secured, as by a bolt 48, to the support member 34.

A developer material density control unit is shown at 50 and is connected to the sump 14 by a bolt assembly 52. A ribbon cable 54 is connected to the density control unit 50 and is supplied with a voltage, as for example +24 volts, by a source 56. The unit 50 has a window 58 therein which is addressed to the developer materials 16 located in the sump 14. The density control unit 50 includes a board assembly 60 which has the necessary electrical components 61 including a light source 62 which is positioned to direct a beam of light upon the developer material 16 within the sump 14 and a pair of photodiodes 64 and 66. One photodiode 64 is located so as to measure light reflected from the developer material 16. The second photodiode 66 receives light directly from the light source 62 and provides means for measuring the light intensity so that the density controller may be calibrated. Also included is an integrated circuit 67 which provides electronic means for measuring the reflective light and calibrating controller and determining the toner density in conjunction with the balance of the components. Such components 61 and their functions are well known in the art and will not be described in detail since the same are not involved in the instant invention.

A bias electrode 68 having an opening 70 therein, which opening is juxtapositioned with the window 58, and a leg 72 is secured to the density control unit 50. The bias electrode 68 receives the positive charge from the cable 54 through the leg 72 being in contact with the unit 50. Thus a large differential voltage is created between the bias electrode 68 and the sump 14 because the latter is polarized opposite in polarity relative to the bias electrode. As the development material 16 is mixed and distributed by the spokes 20, helix 24 and brush 28 it will give off fines primarily of a positive charge. The positive charge of the bias electrode 68 will repulse such fines thereby keeping the window 58 clear for accurate measurements.

What is claimed is:

1. In a toner density controller for determining the density of a development material on a magnetic brush assembly of an electrostatic copier, the combination comprising:

a. a sump;

b. means disposed in said sump for mixing a development material and creating a triboelectric charge in the toner of the development material;

c. a magnetic brush rotatably disposed within said sump;

d. a housing having a window therein which is adjacent said sump;

e. a light source supported by said housing and positioned to direct light through said window;

f. a photocell located in said housing to receive light reflected by development material within said sump;

g. an electrode supported by said housing and having an opening which is in registration with said window;

h. means for supplying a charge to said electrode; and i. means for supplying a charge to said sump which is opposite in polarity to the charge supplied to said electrode.

* * * * *